US005373818A

United States Patent [19]

Unger

[11] Patent Number: 5,373,818

[45] Date of Patent: Dec. 20, 1994

[54] VALVE GEAR ASSEMBLY FOR AN INTERNAL-COMBUSTION ENGINE

[75] Inventor: Harald Unger, Munich, Germany

[73] Assignee: Bayerische Motoren Werke AG, Germany

[21] Appl. No.: 176,280

[22] Filed: Dec. 30, 1993

[30] Foreign Application Priority Data

Aug. 5, 1993 [DE] Germany ..... 4326331

[51] Int. Cl.[5] ..... F01L 1/04; F01L 1/18

[52] U.S. Cl. ..... 123/90.16; 123/90.48; 123/90.39

[58] Field of Search ..... 123/90.15, 90.16, 90.17, 123/90.39, 90.48

[56] References Cited

U.S. PATENT DOCUMENTS

| | | | |
|---|---|---|---|
| 3,413,965 | 12/1968 | Gavasso | 123/90.16 |
| 4,138,973 | 2/1979 | Luria | 123/90.16 |
| 4,526,142 | 7/1985 | Hara | 123/90.16 |
| 4,572,118 | 2/1986 | Baguéna | 123/90.16 |
| 5,018,487 | 5/1991 | Shinkai | 123/90.16 |
| 5,025,761 | 6/1991 | Chen | 123/90.16 |
| 5,111,781 | 5/1992 | Kaku et al. | 123/90.16 |
| 5,119,773 | 6/1992 | Schon et al. | 123/90.16 |
| 5,189,998 | 3/1993 | Hara | 123/90.16 |

FOREIGN PATENT DOCUMENTS

| | | |
|---|---|---|
| 3739246 | 6/1988 | Germany . |
| 3833540 | 4/1990 | Germany . |

*Primary Examiner*—E. Rollins Cross
*Assistant Examiner*—Weilun Lo
*Attorney, Agent, or Firm*—Evenson, McKeown, Edwards & Lenahan

[57] ABSTRACT

An internal-combustion engine comprises at least two inlet stroke valves per cylinder, the courses of the strokes of these stroke valves being adjustable in different manners. The adjustment takes place by means of an eccentric shaft which displaces the supporting point of a transfer element disposed between each cam and each stroke valve, in which case the two eccentrics assigned to one cylinder are of a different geometry. The transfer element is formed by a valve lever which is supported on the eccentric and is actuated by the cam, which valve lever, in turn, acts upon a rocker lever. The respective contact surfaces are formed by rollers. A further transfer element, which has a crank path, is also described.

12 Claims, 8 Drawing Sheets

VALVE GEAR ASSEMBLY FOR AN INTERNAL-COMBUSTION ENGINE

BACKGROUND AND SUMMARY OF THE INVENTION

This invention relates to a valve gear assembly for an internal-combustion engine comprising at least two inlet strike valves per cylinder which act in parallel, are each actuated by a cam as well as a transfer element and the courses of the valve strokes of the stroke valves are adjustable so that they differ from one another.

A valve gear assembly of this type is known, for example, from German Patent Document 37 39 246 A1. In this case, the transfer element is constructed as a valve lifter, and individual valve lifters of the stroke valves assigned to a single cylinder can be connected with one another by way of coupling elements. By assigning in this state of the art different cams to the individual valve lifters, it is possible to actuate, by means of the corresponding control of these valve lifter couplings, a defined stroke valve either directly by the cam assigned to it or by the cam of another stroke valve. The course of the valve stroke of this defined stroke valve can therefore be changed in a different manner than that of another stroke valve.

This known valve gear assembly is disadvantageous in that only stroke courses can be generated on the individual stroke valves which are predetermined by the actually existing cams. Further variations are not possible in this case. Also the coupling elements of the valve lifters or transfer elements experience extremely high mechanical stress.

It is therefore an object of the invention to indicate measures carried out on a valve gear assembly comprising an least two stroke valves per cylinder which act in parallel to one another, by means of which measures the courses of the stroke valves can be adjusted in a varied manner and differently from one another.

For achieving this object, it is provided that the supporting points of the transfer elements can be adjusted by way of rotatable eccentrics disposed on a common eccentric shaft, the elevation curves of the at least two eccentrics per cylinder differing from one another. Advantageous further developments are contained in preferred embodiments of the invention.

According to the invention, the supporting points of the transfer elements which are connected between the individual cams as well as the individual valves can be adjusted. These transfer elements may be a valve lifter as in the above-mentioned state of the art or a valve lever or rocker lever; however, other embodiments are also conceivable, such as a link or crank element having a link path for a roller. When the supporting point of this rocker lever or valve lifter or link element is displaced, a changed course of the stroke will occur for the respective assigned stroke valve because the cam stroke is transferred in a different manner. Although this principle of varying the course of the valve stroke is known per se (German Patent Document DE 38 33 540 C2), this known construction does not indicate how the supporting point of the transfer element can be displaced in a simple manner.

According to the invention, this takes place by means of eccentrics on which the transfer elements are supported. These eccentrics are part of a common eccentric shaft—if several cylinders are arranged in a row, this eccentric shaft may extend along all cylinders— which can be rotated in a simple manner. Furthermore, according to the invention, the eccentrics differ which are assigned to a single cylinder. It is therefore possible to actuate the valves assigned in turn, as desired, to these individual eccentrics in manners that differ from one another, or to adjust the courses of their stroke in manners that differ from one another.

Other objects, advantages and novel features of the present invention will become apparent from the following detailed description of the invention when considered in conjunction with the accompanying drawings.

DETAILED DESCRIPTION OF THE PREFERRED EMBODIMENTS

Figure 1:
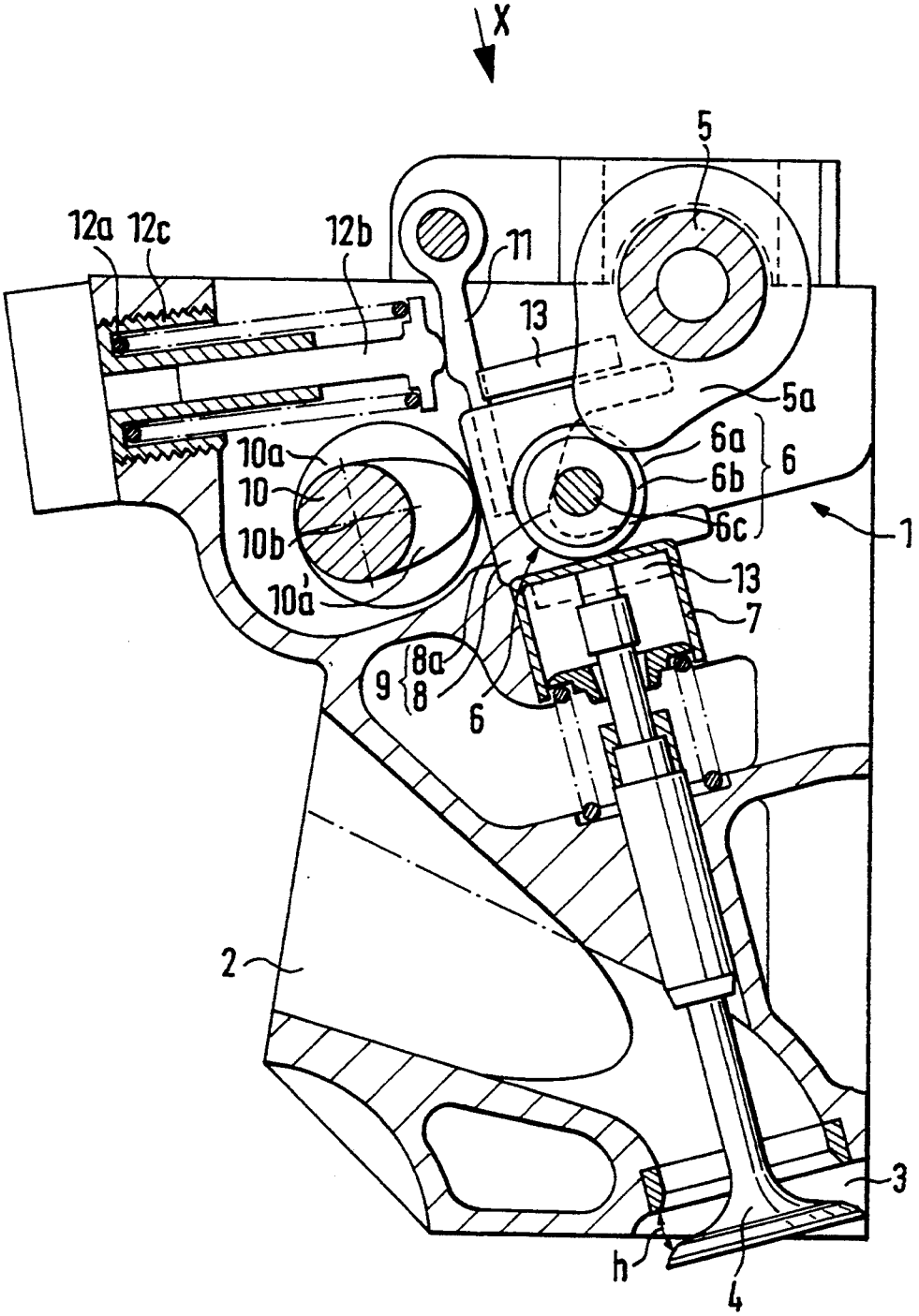
FIG. 1 is a partial cross-sectional schematic view of a cylinder head of an internal-combustion engine comprising a valve gear assembly constructed according to a preferred embodiment of the invention, in which the maximal cam stroke is converted to a maximal valve stroke.

Reference number 1 indicates a cylinder head of an internal-combustion engine. In the representation according to FIG. 1, this cylinder head extends perpendicularly to the drawing plane along several cylinders. At least two inlet ports 2 to a combustion chamber 3 exist per cylinder, one stroke valve 4 being provided per inlet port 2 in a known manner. This stroke valve is actuated by a cam 5*a* of a camshaft 5, in which case the cam 5*a* acts upon a roller 6 which, in turn, rolls on the tappet 7 of the stroke valve 4.

Figure 3:
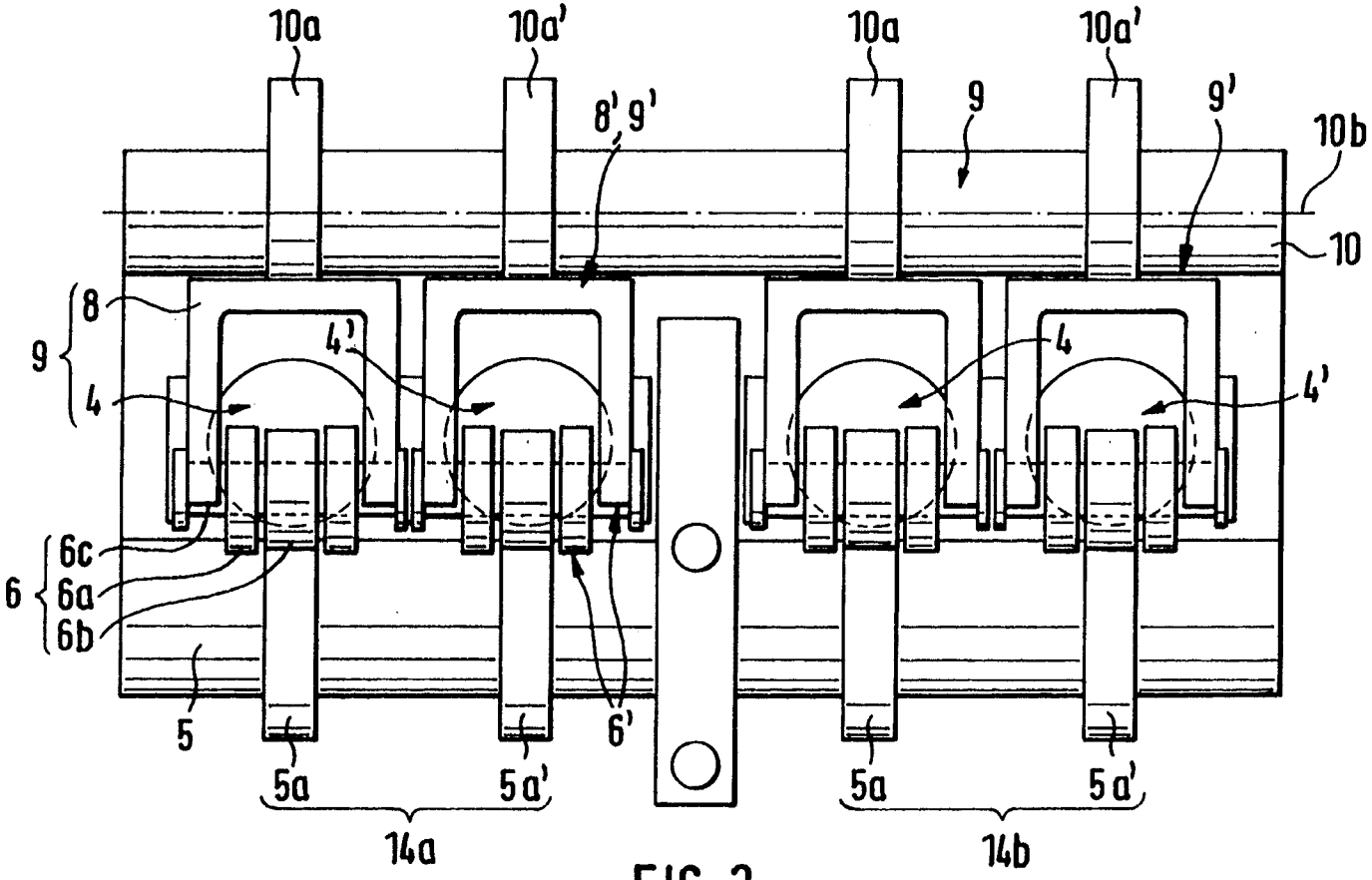
FIG. 3 is a partial view taken from direction X in FIG. 1.

As also indicated in FIG. 3, the roller 6 is constructed in a step shape and has several rolling steps 6*a*, 6*b*, 6*c*. By means of rolling step 6*a*, the roller 6 rests on the tappet 7, while rolling step 6*b* has contact with the cam 5*a*. By means of rolling step 6*c*, the roller 6 finally rolls on a crank guide path 8*a* of a crank element 8 so that, as a whole, the roller 6 is guided by means of this crank element 8 corresponding to the crank path 8*a*. On the whole, the crank element 8 as well as the roller 6 therefore form the so-called transfer element 9 situated between the cam 5*a* and the stroke valve 4.

Figure 2:
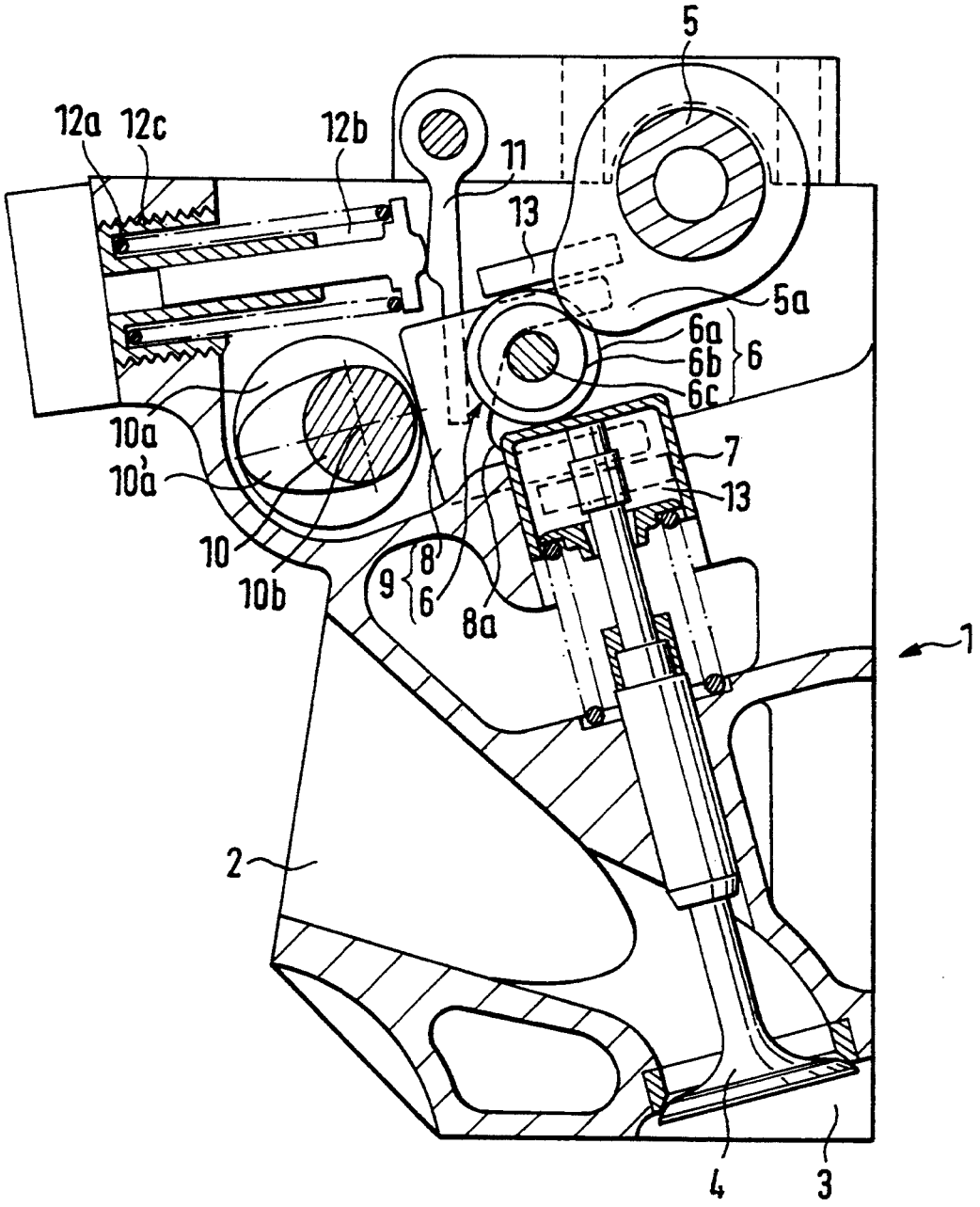
FIG. 2 is a view of the same arrangement as in FIG. 1, in which the maximal cam stroke causes an only minimal valve stroke.

As illustrated, the crank element 8 of this transfer element 9 is supported on an eccentric 10*a* which is machined out of an eccentric shaft 10. When the eccentric shaft 10 is now rotated about its longitudinal axis 10*b*—two different positions are illustrated in FIGS. 1, 2—, the supporting point of the crank element 8 of the transfer element 9 is displaced. As a result, the position of the roller 6 or of the crank path 8a will also change, which finally guides the roller 6 which is moved by means of the rotating cam 5a. As a result of the change of the supporting point of the transfer element 9, however, —as illustrated—different valve strokes are obtained with the same cam stroke. FIG. 1 illustrates the maximally achievable valve stroke h in the case of a maximal cam stroke. In contrast, in FIG. 2, the eccentric shaft 10 is rotated by 180° about its longitudinal axis 10b. From the resulting displacement of the transfer element 9, and in the case of a maximal cam stroke, a valve stroke of the amount of almost 0 is obtained; that is, the stroke valve 4 is opened up only minimally.

For ensuring the described function, a restoring lever 11 is required which is also applied to the rolling step 6a of roller 6 and therefore presses this roller continuously against the cam 5a. This restoring lever 11 is acted upon correspondingly by a pressure spring 12a. For this purpose, the pressure spring 12a is clamped between a pressure element 12b acting upon the restoring lever 11 and a guiding element 12c screwed into the cylinder head 1. The longitudinal guide 13 for the crank element 8 is illustrated only in principle.

As illustrated in FIG. 3, two stroke valves 4, 4' are provided for each individual cylinder 14a, 14b of the cylinder head 1 of the internal-combustion engine. A separate cam 5a, 5a' as well as a separate transfer element 9, 9' in the form of a separate crank element 8, 8' as well as a separate roller 6, 6' are assigned to each stroke valve 4, 4' of each individual cylinder 14a and 14b. In this case, each crank element 8, 8' is supported on a separate eccentric 10a, 10a' of the eccentric shaft 10 extending along the whole cylinder head 1. As illustrated in FIGS. 1, 2, the two eccentrics 10a, 10a' assigned to a cylinder 14a, 14b differ in their geometry. The two eccentrics 10a, 10a' of a cylinder are identical only in the points of the minimal and of the maximal eccentric stroke. Therefore, when the eccentric shaft 10 is in the position illustrated in FIG. 2, despite a maximal cam stroke, the two stroke valves 4, 4' of a cylinder remain almost closed. In contrast, when the eccentric shaft 10 is in the position according to FIG. 1, the two stroke valves 4, 4' (valve stroke h) are opened maximally while the cam stroke is maximal. On the other hand, in intermediate positions of the eccentric shaft, the two stroke valves 4, 4' are opened to different widths in the case of a maximal cam stroke. The course of the valve stroke of these two stroke valves 4, 4' per cylinder 14a, 14b can therefore be varied in manners that differ from one another by adjusting the eccentric shaft 10.

Figure 4:
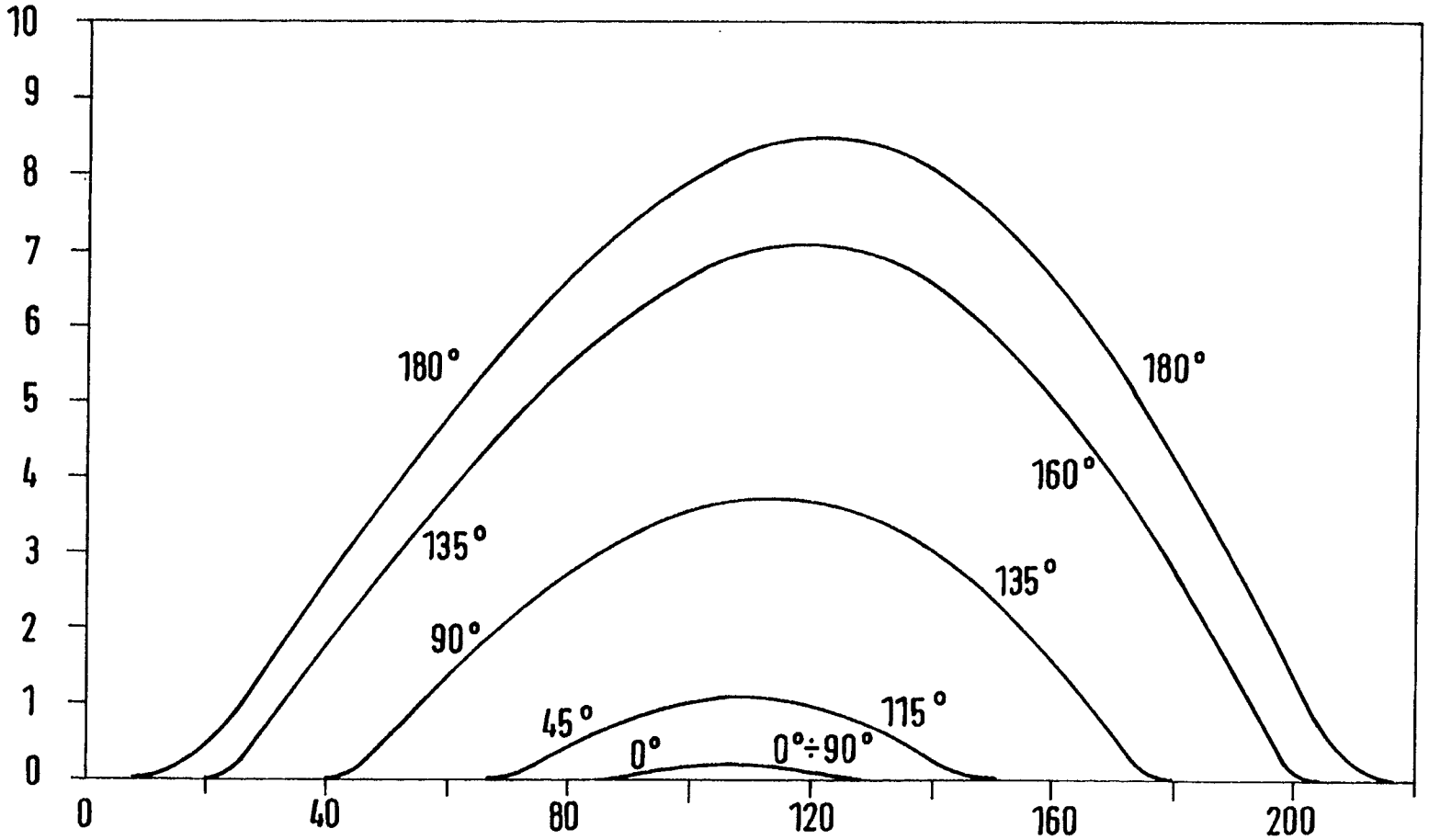
FIG. 4 is a diagram depicting several possible valve stroke courses in a diagram.

This is also illustrated in FIG. 4 which shows different courses of the valve strokes in a diagrammatic representation. The crank angle or the camshaft angle is entered on the abscissa; the ordinate indicates the achievable valve stroke. In this case, the pertaining position of the eccentric shaft 10 is indicated for each of the five courses of the valve stroke which are used as examples. Here, the numerical value indicated on the ascending branch relates to the first stroke valve 4, while the numerical value indicated on the descending branch indicates the required eccentric shaft position for the second stroke valve 4'. In this case, the position of the eccentric shaft 10 is described by angular degrees, the position according to FIG. 2 corresponding to 0°, and the position according to FIG. 1 corresponding to the value of 180°.

It is therefore demonstrated that, as mentioned above, in the case of the eccentric shaft position 0°, the two stroke valves 4, 4' carry out only an extremely small valve stroke, while, in the case of the eccentric shaft position 180°, both stroke valves 4, 4' reach their maximal valve stroke h. However, the stroke valve 4' also retains its minimally possible valve stroke in the case of an eccentric shaft position of 45° and 90°, while, at these positions, the stroke valve 4 already carries out clear strokes.

Different types of valve stroke courses of two stroke valves per cylinder which act in parallel are desirable in order to improve the charge cycle dynamics as well as the swirl of the charge entered into the combustion chamber 3. By means of the illustrated construction as well as by means of the further construction described in the following, such valve stroke characteristics can be achieved in a simple manner for at least two stroke valves per cylinder which act in parallel.

In the second embodiment according to FIG. 5, reference number 1 again indicates a cylinder head of an internal-combustion engine. In the figure, this cylinder head also extends perpendicularly to the plane of the drawing along several cylinders. At least two inlet ports 2 to the combustion chamber 3a are provided for each cylinder, one stroke valve 4 being provided for each inlet port 2 (shown on left side in FIG. 5). Each stroke valve 4, 4' is actuated by one cam 5a, 5a' respectively of a camshaft, in which case each cam acts upon a valve lever 16, 16' which, in turn, acts upon a rocker arm 17, 17'. In the rocker lever 17, 17', a hydraulic play compensation element 18, 18' is disposed on which the valve stem of the stroke valve 4, 4' is finally supported. Together, the valve lever 16 as well as the rocker lever 17 form a transfer element 19, 19' by means of which the course of the stroke of the cam 5a, 5a' is transferred to the stroke valve 4, 4'.

As illustrated, the transfer element 19 or the valve lever 16 is supported on an eccentric 10a which is machined out of an eccentric shaft 10. When the eccentric shaft 10 is rotated about its longitudinal axis 10b, the supporting point of the valve lever 16 or of the transfer element 19 is displaced. As a result of such a change of the supporting point of the transfer element 19, different valve strokes are obtained while the cam stroke is the same because, based on the changed support, during the rotation of the cam 5a, the valve lever 16 travels along a different movement path than the rocker lever 17, so that the rocker lever 17 is also deflected in a different manner. In particular, it becomes possible in this manner to achieve, in addition to a maximal valve stroke, also a valve stroke of an amount of almost 0, in the case of which the stroke valve 4 is opened only minimally.

The valve lever 16 is guided by a bolt-slot guide which, as a whole, has the reference number 20. As illustrated, the valve lever 16 has a slot 20a by means of which it is hung into a bolt 20b which is fastened in a bearing 20c on the cylinder head. Because of this bolt-slot guide 20, the valve lever 16 can therefore take up different positions. Naturally, the bolt-slot guide 20 may also be constructed in a reversed manner; that is, the bolt 20b may be fastened to the valve lever 16 and the slot 20a may then be provided in the cylinder head bearing 20c. For ensuring the described adjusting function, a restoring mandrel 11 is also applied to a step 16a of the valve lever 16, which restoring mandrel 11 always presses the valve lever against the cam 5*a* as well as against the eccentric 10*a*. For this purpose, the restoring mandrel 11 is correspondingly acted upon by a pressure spring 12*a* which is supported on a guide element 12*c* screwed into the cylinder head 1.

Figure 5:
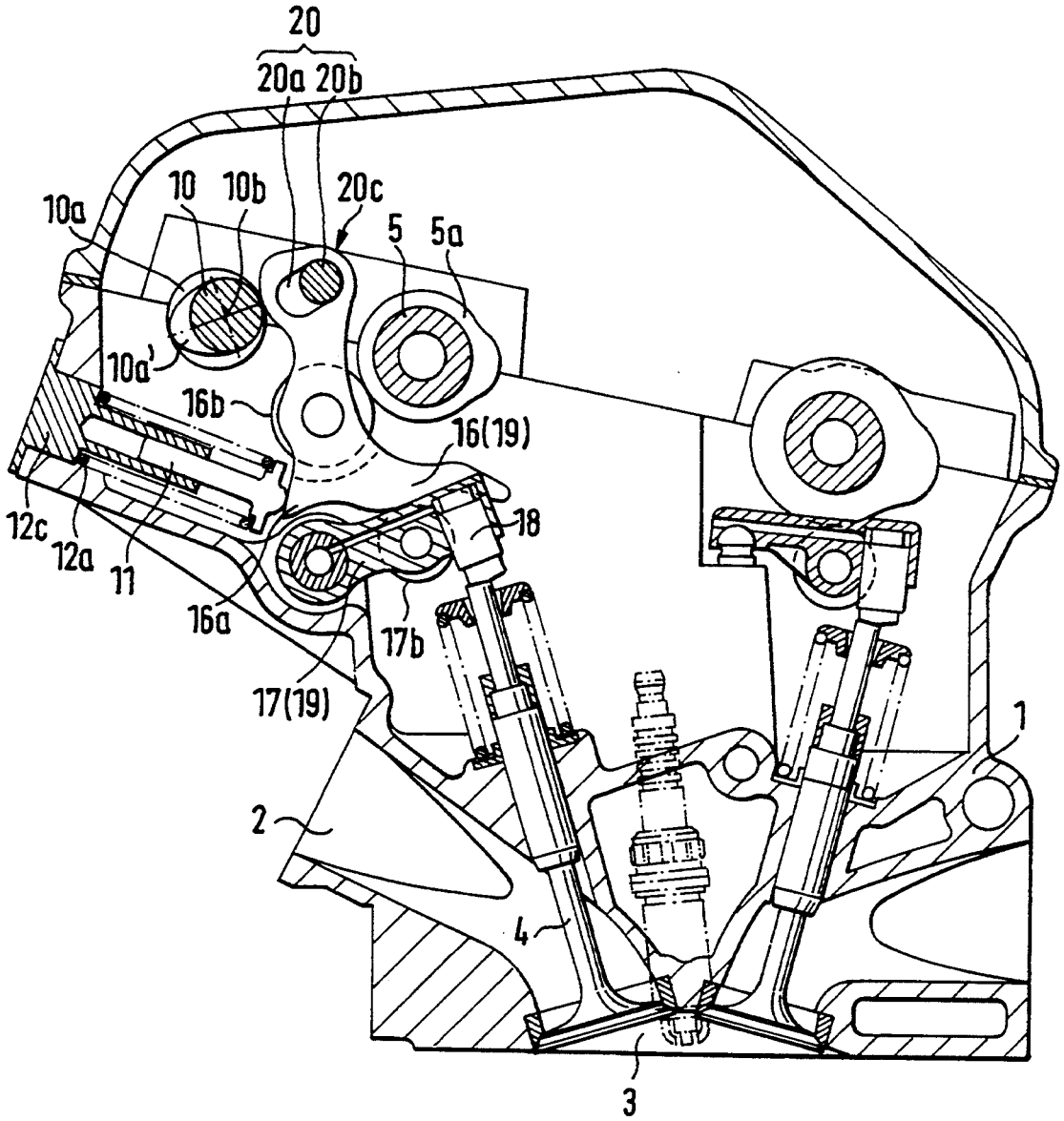
FIG. 5 is a schematic cross-sectional view of a cylinder head of an internal-combustion engine comprising another valve gear according to the invention.
Figure 6:
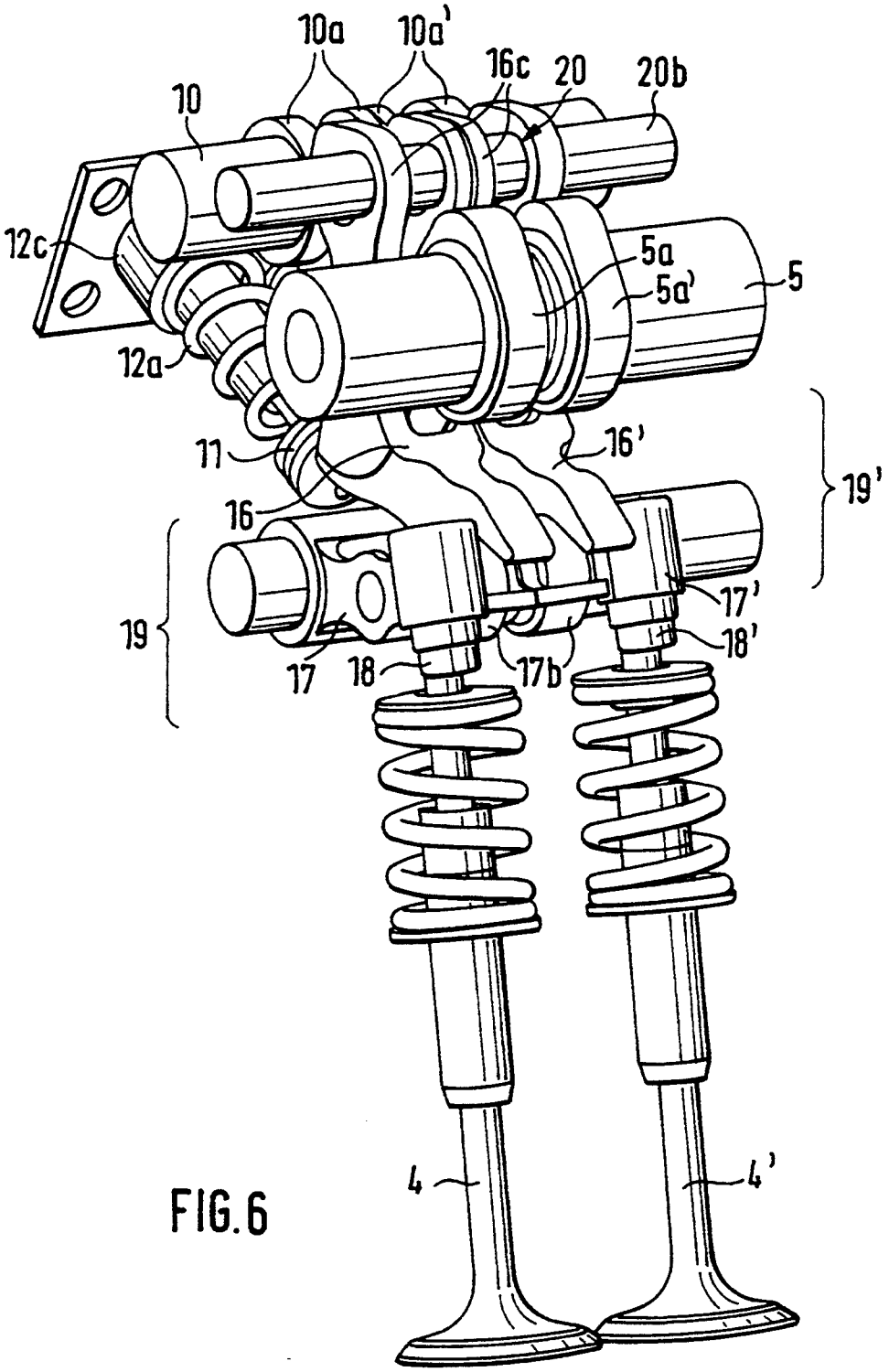
FIG. 6 is a perspective view of the valve gear assembly from FIG. 5 for a single cylinder.
Figure 7:
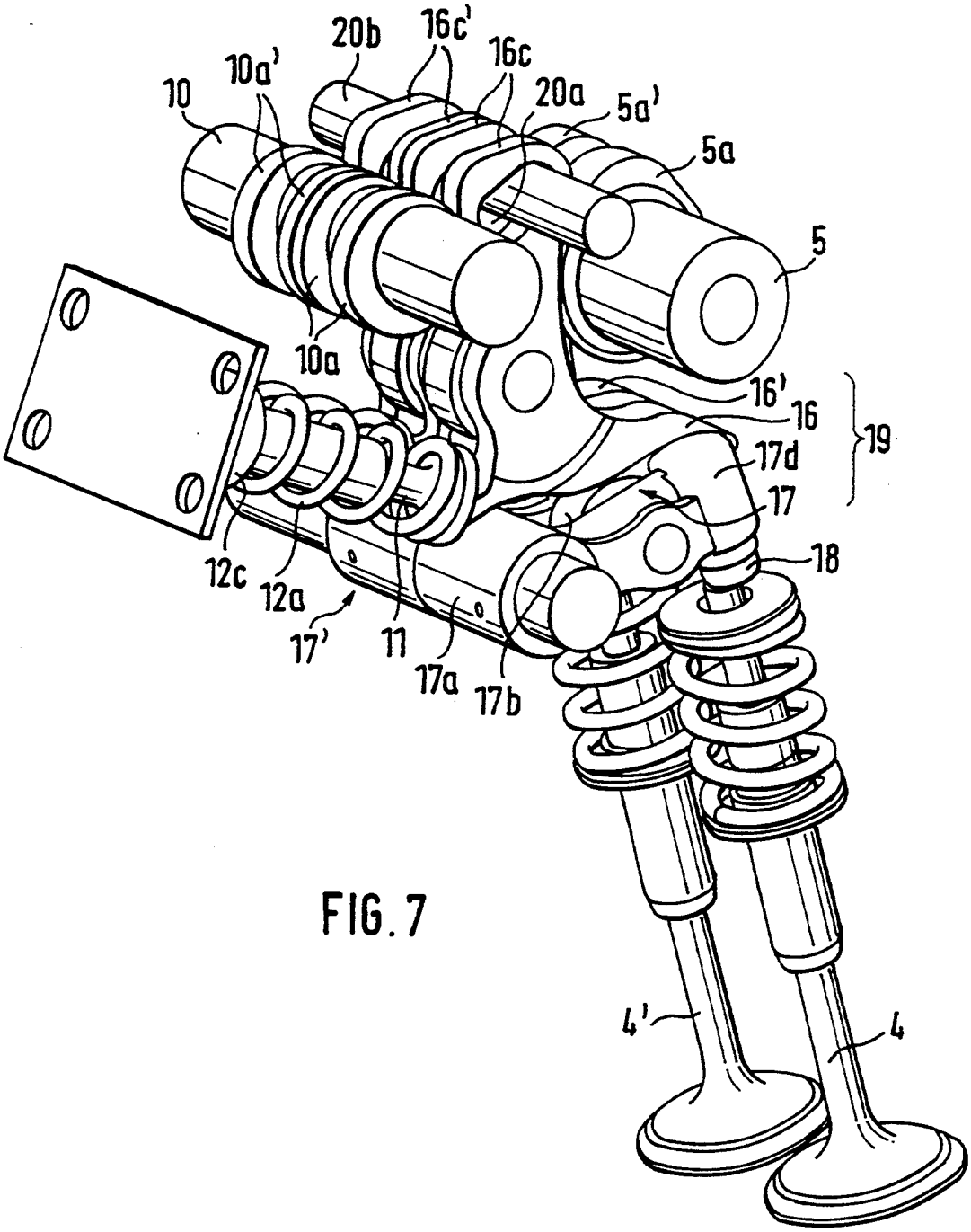
FIG. 7 is a view from FIG. 6 in a different perspective.

As indicated in FIGS. 6, 7, two stroke valves 4, 4' are provided for each cylinder or combustion chamber 3 of the cylinder head 1 of the internal-combustion engine. A separate cam 5*a*, 5*a'* as well as a separate transfer element 19, 19' in the form of a separate valve lever 16, 16' as well as a separate rocker lever 17, 17' are assigned to each stroke valve 4, 4'. In this case, each valve lever 16, 16' is supported on a separate eccentric 10*a*, 10*a'* of the eccentric shaft 10 which extends along the whole cylinder head 1. As illustrated in FIG. 5, the two eccentrics 10*a*, 10*a'* which are assigned to a cylinder or combustion chamber 3 differ in their geometry. The two eccentrics 10*a*, 10*a'* of one cylinder/combustion chamber are identical only in the points of the minimal as well as the maximal eccentric stroke. In the illustrated position of the minimal eccentric stroke, the two stroke valves 4, 4' of one cylinder remain almost closed despite a maximal cam stroke. If, in contrast, starting form the shown position, the eccentric shaft 10 is rotated by 180° and, because of their then maximal eccentric stroke, the eccentrics 10*a*, 10*a'* therefore adjust the valve levers 16, 16' correspondingly, in the case of a maximal cam stroke, the two stroke valves 4, 4' are opened maximally. In contrast, in the intermediate positions of the eccentric shaft 10, the two stroke valves 4, 4' are opened to different widths in the case of a maximal cam stroke. The course of the valve stroke of these two stroke valves 4, 4' can therefore be changed by the adjusting of the eccentric shaft 10 in manners which differ from one another.

Because of the fact that the transfer element 19 is formed by a valve lever 16 as well as by a rocker lever 17 connected behind it, an extremely reliable construction is obtained which, in addition, is distinguished by a space-saving design. In order to minimize the friction losses in the valve gear, a rolling friction is implemented in the contact areas between the cam 5*a* and the valve lever 16 as well as between the valve lever 16 and the rocker lever 17; that is, the valve lever 16 carries a roller 16*b*, and the rocker lever 17 carries a roller 17*b*.

Figure 8:
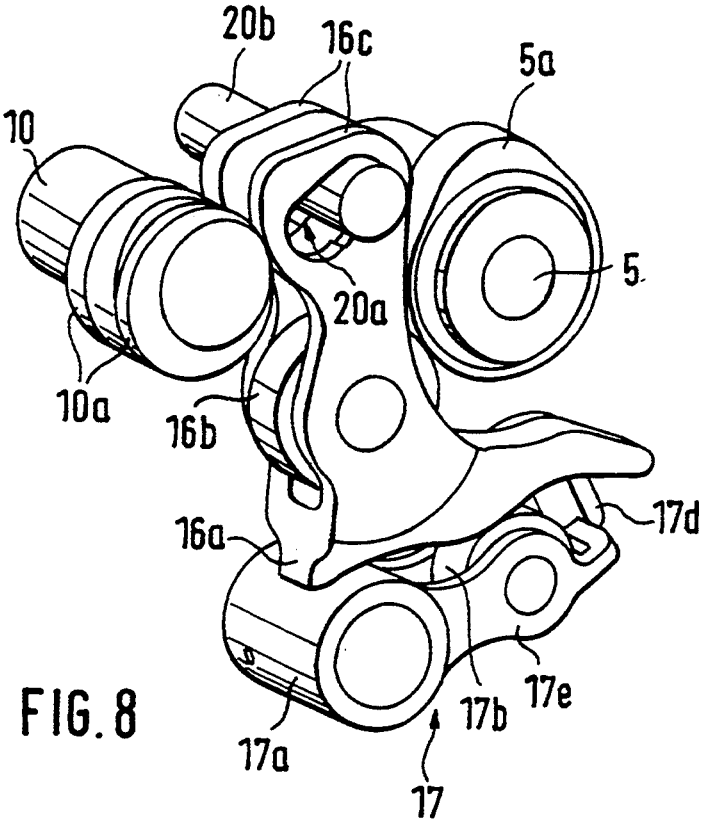
FIG. 8 is a perspective representation particularly of the transfer element of this other valve gear.

The roller 16*b* of each valve lever 16 is guided between the two arms 16*c* of the valve lever 16 which, in sections, has a two-armed construction and is disposed on a roll shaft which is not indicated in detail and is fastened in these valve lever arms. Because of the two-armed construction of the valve lever 16 in the section which is particularly illustrated in FIG. 8, —especially for the purpose of a weight reduction—, the eccentric 10*a* assigned to this valve lever 16 is also constructed in two parts; that is, a separate eccentric disk is provided for each of the valve lever arms 16*c*, in which case the two adjacent eccentric disks, which are spaced with respect to one another only by the width of the roller 16*b*, are naturally of the same configuration.

Figure 9:
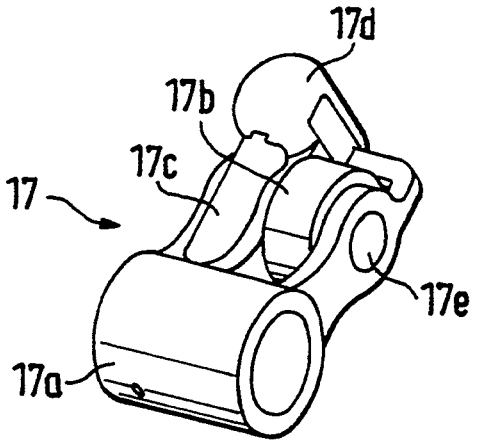
FIG. 9 is a perspective representation of the rocker lever which is part of the transfer element of FIG. 8.

As known per se, the rocker lever 17 has a rocker lever bearing 17*a*, starting from which a rocker lever arm 17*c* leads to a receiving device 17*d* which carries the hydraulic play compensating element 18 affecting the stroke valve 4. The roller 17*b* is arranged laterally on the rocker lever arm 17*c*. By means of this asymmetrical design, which is illustrated particularly clearly in FIG. 9, an extremely space-saving construction is obtained. In this case, the roller 17*b* is also disposed on a shaft which, on one side, is fastened to the rocker lever arm 17*c* and, on the other side, is fastened to another auxiliary arm 17*e*. In this case, this auxiliary arm 17*e* also leads from the rocker lever arm 17*a* to the receiving device 17*d*.

The same advantages with respect to a reliable, simple and space-saving construction, which occur because of the facet that the transfer element is formed by the valve lever 16 as well as the rocker lever 17, will naturally also occur when the contact surfaces between the cams 5*a* as well as the transfer element 19 as well as inside the latter are not formed by the rolls 16*b*, 17*b* but when the contact surfaces are constructed as crowned or straight sliding surfaces. In this case, the two described systems are distinguished not only by a simple constructive design but also by an extreme reliability. Furthermore, a plurality of other deviations from the shown embodiments, particularly of a constructive type, are also possible without leaving the content of the claims.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A valve gear assembly for an internal-combustion engine comprising:

at least two stroke valves per engine cylinder, a cam for actuating each valve, an adjustable transfer device interposed between each cam and each valve for changing the respective strokes of the valves, wherein said transfer devices include transfer element supporting points which are adjustable via rotatable eccentrics disposed on a common eccentric shaft, and wherein elevation curves of the at least two eccentrics for the corresponding at least two valves of a cylinder differ from one another.

2. A valve gear assembly according to claim 1, wherein said common eccentric shaft includes eccentrics for a plurality of cylinders arranged in a row.

3. A valve gear assembly according to claim 1, wherein the transfer device includes a roller which rolls between a tappet of a stroke valve as well as the cam, which roller is also guided by a crank element which can be adjusted by means of the eccentric.

4. A valve gear assembly according to claim 3, wherein the roller has different rolling steps which interact with the cam, with the tappet and with the crank guide path of the crank element.

5. A valve gear assembly according to claim 3, wherein a restoring lever is applied to the roller.

6. A valve gear assembly according to claim 1, wherein the transfer device includes a valve lever which is supported on the eccentric and which acts upon a rocker lever.

7. A valve gear assembly according to claim 6, wherein the valve lever has a two-armed construction and carries a roller on which the cam rolls off, wherein one separate eccentric disk respectively is provided for each of the two valve lever arms, wherein the rocker lever carries a roller which is arranged laterally on a rocker lever arm which leads from a rocker lever bearing to a receiving device for a play compensating element on which the stroke valve is supported, which roller is acted upon by the valve lever, and wherein the valve lever is disposed on the cylinder head of the internal-combustion engine by way of a bolt-slot guide, the slot being provided in one of the valve lever and the cylinder head bearing.

8. A valve gear assembly according to claim 2, wherein the transfer device includes a roller which rolls between a tappet of a stroke valve as well as the cam, which roller is also guided by a crank element which can be adjusted by means of the eccentric.

9. A valve gear assembly according to claim 8, wherein the roller has different rolling steps which interact with the cam, with the tappet and with the crank guide path of the crank element.

10. A valve gear assembly according to claim 9, wherein a restoring lever is applied to the roller.

11. A valve gear assembly according to claim 6, wherein said common eccentric shaft includes eccentrics for a plurality of cylinders arranged in a row.

12. A valve gear assembly according to claim 11, wherein the valve lever has a two-armed construction and carries a roller on which the cam rolls off, wherein one separate eccentric disk respectively is provided for each of the two valve lever arms, wherein the rocker lever carries a roller which is arranged laterally on a rocker lever arm which leads from a rocker lever bearing to a receiving device for a play compensating element on which the stroke valve is supported, which roller is acted upon by the valve lever, and wherein the valve lever is disposed on the cylinder head of the internal-combustion engine by way of a bolt-slot guide, the slot being provided in one of the valve lever and the cylinder head bearing.

* * * * *